United States Patent [19]

Collins

[11] 4,241,967

[45] Dec. 30, 1980

[54] ELECTRICAL CONNECTOR ASSEMBLY SEALING GROMMET

[75] Inventor: Gordon T. Collins, Sidney, N.Y.

[73] Assignee: The Bendix Corporation, Southfield, Mich.

[21] Appl. No.: 71,462

[22] Filed: Aug. 31, 1979

[51] Int. Cl.[3] ..... H01R 13/48

[52] U.S. Cl. ..... 339/59 M

[58] Field of Search ..... 339/59-63, 339/94 R, 94 M, 103 M, 103 B, 103 R, 217 S

[56] References Cited

U.S. PATENT DOCUMENTS

| | | | |
|---|---|---|---|
| 3,221,292 | 11/1965 | Swanson et al. | 339/63 M |
| 3,689,866 | 9/1972 | Kelly | 339/217 S |
| 4,072,383 | 2/1978 | Cameron et al. | 339/59 R |

*Primary Examiner*—Neil Abrams

*Attorney, Agent, or Firm*—Raymond J. Eifler; William G. Kratz, Jr; C. Dennis Lacino

[57] ABSTRACT

A sealing grommet for sealing the wires extending from contacts, retained in a dielectric insert of an electrical connector assembly, to protect the contacts from moisture. The sealing grommet 19 has a plurality of axial passages 33 therethrough which communicate with axial bores 7 in the dielectric insert 3 which contains the contacts 5, and wires 27 pass through the passages 33. First sealing webs 37 and second sealing webs 39 extend inwardly from wall 35 towards the axis of the passages 33 and provide a moisture seal for contacts 5 contained within the insert 3 while providing for use of wires of varying diameters in a single grommet.

5 Claims, 5 Drawing Figures

ELECTRICAL CONNECTOR ASSEMBLY SEALING GROMMET

BACKGROUND OF THE INVENTION

The present invention relates to electrical connector assemblies and, more specifically, to a moisture sealing grommet for use in such assemblies that provides for sealing of the contacts contained in such assemblies against moisture over a range of wire diameters for the wires connected to the contacts and passing through the grommet.

Electrical connector assemblies generally include a plug and a receptacle, each of which contains a dielectric insert that has electrical contacts retained within bores in the inserts. The rear portion of the assembly contains a sealing grommet, through which the wires connected to the contacts pass, and which grommet seals the contacts contained in the insert from moisture. An example of the type of connector assembly to which the present sealing grommet may be applied is the type of connector illustrated in U.S. Pat. No. 4,082,398, assigned to the assignee of the present invention, the contents of which are incorporated by reference herein. A further example of a type of connector assembly, containing a sealing grommet, to which the present sealing grommet may be applied is the type of connector assembly illustrated in U.S. Pat. No. 3,221,292, also assigned to the assignee of the present inventor, the contents of said patent also being incorporated by reference herein. The grommet described in U.S. Pat No. 3,221,292 contains two webs in each of the axial passages, a terminal web and inner web, with the inner web of one passage being misaligned with the inner web of an adjacent passage.

The moisture sealing capability of the grommet has taken an additional significance due to the requirement for reduced weight, for example on aircraft, and the increasing use of low current carrying circuits, which have resulted in a decrease in the diameter of wires leading to the contacts within an insert and which pass through and must be supported by the grommet, as well as sealed by the grommet to protect the contacts from moisture. Insulation thickness on wires has also been reduced, which increases the chances of an inefficient seal within conventional grommets. The importance of such a moisture seal is evidenced by the specifications required, for example, in connectors designed to Military Specification, MIL-C-38999G, and the humidity or moisture sealing requirements designated therein.

With the use of smaller diameter wires, such wires must be carefully supported outside the grommet to prevent elongation of sealing webs, used in conventional moisture sealing grommets, and thereby reduce or destroy the moisture sealing properties of the webs of the grommet that seal the contacts contained in the insert from moisture.

SUMMARY OF THE INVENTION

The present invention comprises an electrical connector assembly and a sealing grommet for use therewith, characterized by a sealing grommet 19 having a plurality of passages 33 therethrough, which are adapted to cooperate with axial bores 7 in a dielectric insert 3, which insert contains contacts 5 connected to wires 27, the passages 33 having circumferential walls 35 from which a plurality of first sealing webs 37 extend, and a plurality of second sealing webs 39 extend, with said second webs 39 extending inwardly towards the axis of the passage 33 a distance greater than the first webs 37. A first web 37 is provided adjacent the rear face 31 of the grommet 19, and preferably two such first webs 37 and two such second webs 39 are provided.

DETAILED DESCRIPTION

The present invention relates to a sealing grommet usable in various electrical connector assemblies wherein contacts are retained within dielectric inserts with the wires leading to said contacts passing through a grommet that seals the connectors from moisture. Examples of such connectors, in which the present grommet may be used, are illustrated in U.S. Pat. Nos. 3,221,292 and 4,082,398 previously referred to herein.

Figure 1:
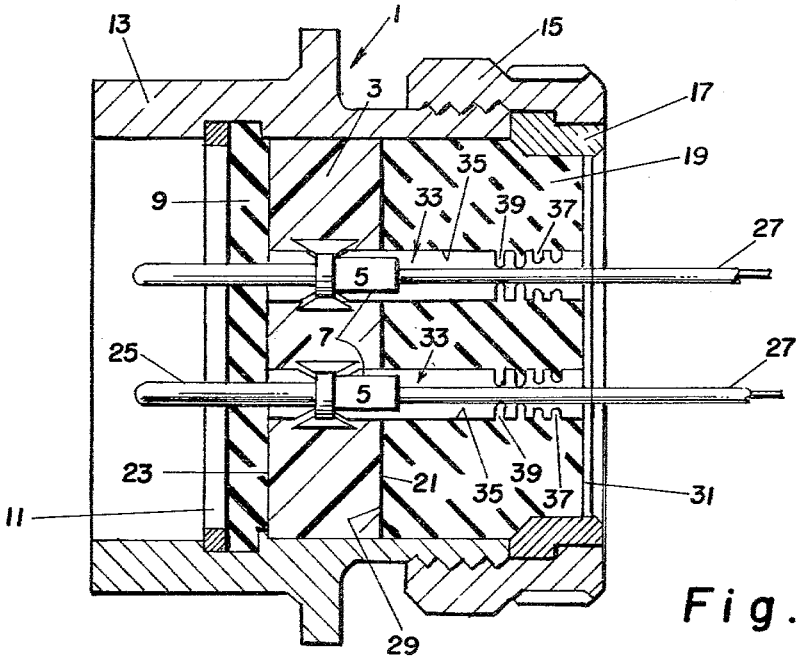
FIG. 1 is a cross-sectional view of a connector assembly using the sealing grommet of the present invention.

As illustrated in FIG. 1, one-half of a connector assembly 1, for use with pin type contacts, has a contact retaining insert 3 formed of dielectric material, a plurality of contacts 5 secured within axial bores 7 of the insert 3, an interfacial seal 9, a front retaining ring 11, a connector shell 13, a retaining nut 15 and a rear retaining nut 17, with the sealing grommet 19 provided to prevent access to the contacts 5 by moisture from the environment. The dielectric insert 3 has a face 21 which contacts the sealing grommet 19 and an opposite face 23 which faces the interfacial seal 9 for the front 25 of the male contacts 5. Wires 27 lead from the contacts 5 through the sealing grommet 19.

As shown, the sealing grommet 19 which is formed of a rubber type material, such as a silicone rubber or neoprene rubber, has a front face 29 and a rear face 31, with a plurality of axial passages 33 therethrough which cooperate with the axial bores 7 of the dielectric insert 3, the passages having a circumferential wall 35. Extending from the circumferential wall 35 of the passages are a plurality of first webs 37 and second webs 39.

Figure 2:
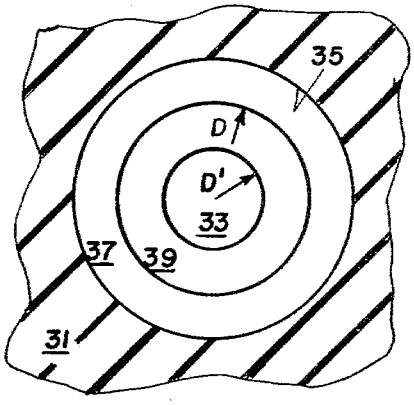
FIG. 2 is an end view showing one of the passages of the grommet of the present invention, with no wire passing therethrough, illustrating the plurality of webs.

The first webs 37 extend inwardly from the circumferential wall 35 of the passages 33 to leave an opening having the diameter d (FIG. 2), while the second webs 39 extend inwardly from the circumferential wall 35 of the passages 33 toward the axis of the passage a distance greater than the first webs 37, to leave a smaller opening having the diameter d'. The provision of the plurality of first and second webs 37 and 39 enable the use of the sealing grommet with a range of wire gauges, such that the grommet may be used in various connector assemblies, without the need for a special grommet for each alteration in wire gauge, while assuring an efficient moisture seal for the contacts.

Figure 3:
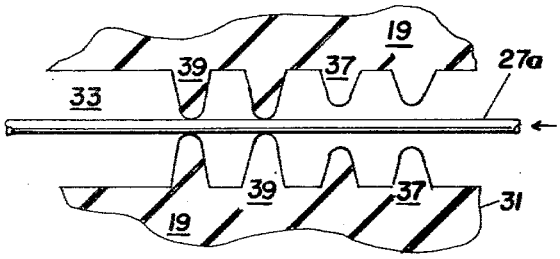
FIG. 3 is a cross-sectional view of one of the passages of the grommet of the present invention wherein a narrow wire is retained and sealed.
Figure 4:
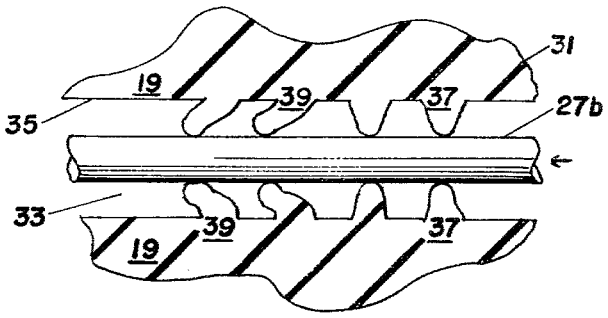
FIG. 4 is a cross-sectional view of one of the passages of the grommet of the present invention wherein a thick wire is retained and sealed.
Figure 5:
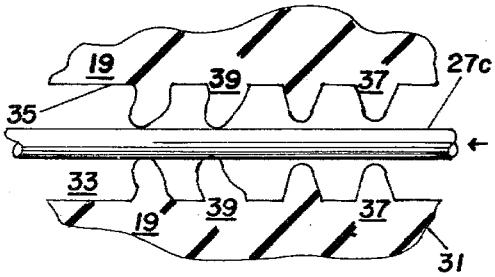
FIG. 5 is a cross-sectional view of one of the passages of the grommet of the present invention wherein a medium size wire is retained and sealed.

In FIGS. 3, 4 and 5 the use of a grommet in sealing contacts, although various gauges of wire may be present, is illustrated. FIG. 3 illustrates one of the passages 33 of a grommet 19 according to the present invention, with a wire 27*a* of minimum diameter for use in connection with the contact. As shown, the contact 5 and the minimum size wire 27*a* attached thereto are inserted through the rear face 31 of the grommet, as indicated by the arrow. The contact 5 and wire 27*a* pass through the passage 33 between the plurality of first webs 37 and then through the plurality of second webs 39 before existing from the front face of the grommet for placement into the dielectric insert 3. The contact 5, which is generally of a larger diameter than the wire 27*a*, must be insertable through the plurality of webs 37 and 39, but these webs, due to their resilient properties, will return to substantially perpendicular relationship to the wall 35 of the passage 33. With the use of a minimum size wire 27*a*, the plurality of first webs 37 will be spaced from the wire 27*a*, but the plurality of second webs 39, due to their extending inwardly toward the axis of the passage 33 a greater distance than webs 37, will contact the wire 27*a* and provide a moisture seal for the contact 5. In addition to the plurality of second webs 39 providing a moisture seal, the first webs 37, when a small diameter wire 27*a* is situated within the passage 33, provide support for the wire 27*a* upon movement of the wires in a nonaxial direction. Thus, movement of the wire 27*a* upwardly, downwardly or sideways, as viewed in FIG. 3, will be restrained by contact with first webs 37.

In FIG. 4, the passage 33 of grommet 19 and the positioning of webs 37 and 39 are illustrated where a maximum diameter wire 27*b* is positioned therein. Upon insertion of the contact 5 and large diameter wire 27*b* through the rear face 31 of the grommet 19 into passage 33, in the direction of the arrow, the webs 37 and 39 will flex to permit passage of the contact 5 therethrough. After the contact 5 has been passed through the passage 33 and into insert 3, the plurality of first webs 37 will contact the wire 27*b* and seal the contact from moisture. The plurality of second webs 39 will remain in a distended position, as shown in the drawing. The stress applied to the second webs 39 may diminish the sealing properties of those webs, but the first webs 37 will still provide an efficient moisture seal. Also, the second webs 39, under stress, could be damaged by the insertion tool used to pass the contact 5 through the passage 33 but, again, first webs 37 will permit entry of the tool and still provide the moisture proof seal.

The illustration in FIG. 5 shows the position of the first webs 37 and second webs 39 after a contact 5 has been passed through passage 33 and the contact has a wire 27*c* of a diameter that is intermediate the minimum diameter wire 27*a* and maximum diameter wire 27*b*. Second webs 39 will be only slightly distended and will seal the contact against moisture, while the first webs 37 will provide support for the wire 27*c* upon movement of the wire in a direction normal to the axis of the passage 33.

While the grommet 19 illustrated in the drawings shows the use of two first webs 37 and two second webs 39 extending from the wall 35 of the passage 33, it should be understood that more than two of either of those webs may be provided. The use of at least two of each of the webs 37 and 39 in each passage 33 is important, however, in order to assure moisture sealing and also provide support for small diameter wires. It is also important that the web closest to the rear face 31 of the grommet 19 be a first web 37, that is, that such web be one which leaves the wider opening through which the wire 27 may be supported by the first web 37. It is an operable embodiment however to alternate first web 37, a second web 39, another first web 37 and a further second web 39 within the passage 33 from the rear face 31 towards the insert 3.

In formation of an electrical connector assembly according to the present invention, the grommet 19 is affixed to dielectric insert 3, with the passages 33 of the grommet 19 in axial alignment with the bores 7 of the dielectric insert 3. The grommet 19 may be affixed to the insert 3 by use of adhesives, such as an epoxy adhesive, or by some other means as is conventionally used. Upon securing of the insert 3, grommet 19 and interfacial seal 9 subassembly, within the connector shell 13 by cooperation of the ring 11, the shell 13, and retaining nuts 15 and 17, the assembly is ready for insertion of the contacts 5. The contacts 5 with connecting wire 27 are then inserted through the rear face 31 of the grommet 19 and through passages 33, the contacts 5 to be retained in bores 7 of the insert 3, with the front 25 of the contacts 5 passing through the interfacial seal 9. The grommets 19 are also usable with inserts which retain female contacts (socket), wherein the female contact and wire would be passed through the grommet 19 and retained within an insert for such female contacts.

The present invention provides an electrical connector assembly having a grommet which provides a moisture seal for contacts contained within a dielectric insert in the assembly while providing for use of wires of various diameters in association with a single grommet.

What is claimed is:

1. A sealing grommet for use in an electrical connector assembly wherein a plurality of electrical contacts are secured within axial bores formed in a dielectric insert, said grommet comprising a molded housing having an abutment face which is adapted to abut the insert, a plurality of axial passages extending through the housing to the abutment face cooperating with the axial bores of said insert, each of said axial passages having a circumferential wall and first and second pairs of resilient sealing webs integral with said housing and extending inwardly from the circumferential wall of each of said passages towards the axis thereof, said second pair of resilient sealing webs being situated between the first pair of resilient sealing webs and the abutment face of the grommet and extending inwardly from the circumferential wall towards the axis thereof a distance greater than said first pair of resilient sealing webs.

2. In an electrical connector assembly wherein a plurality of electrical contacts are retained within axial bores formed in a dielectric insert, and a moisture sealing grommet is provided comprising a housing having a plurality of axial passages therethrough, each said passage having a circumferential wall, through which wires to the contacts pass, and including means for securing the dielectric insert to a face of the moisture sealing grommet in abutting relationship such that the passages of the grommet are coaxial with the bores of the insert, the improvement comprising:

a plurality of resilient first sealing webs integral with the housing and extending inwardly from the circumferential wall of each said passage towards the axis thereof, and a plurality of resilient second sealing webs extending inwardly from the circumferential wall of each said passage towards the axis thereof a distance greater than said first webs, said plurality of second webs being situated between at least one of said first webs and the face of the grommet being secured to the dielectric insert.

3. An electrical connector assembly as defined in claim 2 wherein both of said second webs are situated between the first webs and the face of the grommet secured to the dielectric insert.

4. In an electrical connector assembly wherein a plurality of electrical contacts are retained within axial bores formed in a dielectric insert, and a moisture sealing grommet is provided comprising a housing having a plurality of axial passages therethrough, each said passage having a circumferential wall, through which wires to the contacts pass, and including means for securing the dielectric insert to a face of the moisture sealing grommet in abutting relationship such that the passages of the grommet are coaxial with the bores of the insert, the improvement comprising:

a pair of resilient first sealing webs integral with said housing and extending inwardly from the circumferential wall of each of said passages towards the axis thereof, and a pair of resilient second webs, situated between the pair of first webs and the face of the grommet secured to the dielectric insert, extending inwardly from the circumferential wall of each passage towards the axis thereof a distance greater than said first webs.

5. A grommet for use in moisture sealing a plurality of different diametered electrical wires passing therethrough to an insert of an electrical connector, said grommet comprising:

a body having a forward face for abutting against the connector insert and receiving the wires from the connector, a rearward face for passing the wires outwardly from the grommet and a plurality of wire receiving passages extending between the faces, each passage having an axis and a circumferential wall circumposed about the axis;

a first equal sized plurality of resilient sealing webs extending inwardly from the circumferential wall and towards the axis of the passage; and a second equal sized plurality of resilient sealing webs extending inwardly from the wall and towards the axis of the passage a distance greater than the first plurality of resilient sealing webs, said second equal sized plurality of resilient sealing webs being situated between at least one of said first equal sized plurality of resilient sealing webs and the forward face of the grommet.

* * * * *